US005547180A

United States Patent [19]

Brotherston

[11] Patent Number: 5,547,180

[45] Date of Patent: Aug. 20, 1996

[54] SHEET FEED AND PRESENTING ASSEMBLIES AND METHOD

[75] Inventor: Colin P. Brotherston, Emsworth, United Kingdom

[73] Assignee: De La Rue Systems Limited, London, United Kingdom

[21] Appl. No.: 314,344

[22] Filed: Sep. 28, 1994

[30] Foreign Application Priority Data

Sep. 29, 1993 [GB] England ..... 9320085

[51] Int. Cl.[6] ..... B65H 3/12

[52] U.S. Cl. ..... 271/96; 271/104; 271/108; 271/31.1

[58] Field of Search ..... 271/94, 96, 104, 271/108, 112, 121, 123, 126, 31.1, 11, 171, 149, 146

[56] References Cited

U.S. PATENT DOCUMENTS

| | | | |
|---|---|---|---|
| 2,631,851 | 3/1953 | Jones . | |
| 2,815,207 | 12/1957 | Skow . | |
| 3,041,067 | 6/1962 | Fux et al. . | |
| 3,674,255 | 7/1972 | Arnell . | |
| 3,976,291 | 8/1976 | Bernardi et al. | 271/104 X |
| 3,984,096 | 10/1976 | Barkley . | |
| 3,999,666 | 12/1976 | Lloyd et al. . | |
| 4,042,235 | 8/1977 | Wanner et al. . | |
| 4,440,388 | 4/1984 | Divoux et al. . | |
| 4,653,742 | 3/1987 | Sasaki et al. . | |
| 4,718,809 | 1/1988 | Krasuski et al. | 271/121 X |
| 4,813,662 | 3/1989 | Merwarth et al. | 271/146 X |
| 4,978,416 | 12/1990 | Potter et al. | 271/112 X |
| 5,295,675 | 3/1994 | Hain | 271/104 X |
| 5,354,045 | 11/1994 | Boldrini et al. | 271/104 X |

FOREIGN PATENT DOCUMENTS

| | | |
|---|---|---|
| 0228545 | 7/1987 | European Pat. Off. . |
| 0413471 | 2/1991 | European Pat. Off. . |
| 2282388 | 3/1976 | France . |
| 2489798 | 3/1982 | France . |
| 1018883 | 11/1957 | Germany . |
| 2062108 | 10/1972 | Germany . |
| 3311976 | 10/1984 | Germany . |
| 3921582 | 1/1991 | Germany . |
| 1228575 | 4/1971 | United Kingdom . |
| 2055085 | 2/1981 | United Kingdom . |

OTHER PUBLICATIONS

IBM Technical Disclosure Bulletin, vol. 19 No. 2 (Jul. 1976), pp. 664–665, "Currency Cartridge", by J. J. Lynott.

*Primary Examiner*—David H. Bollinger
*Attorney, Agent, or Firm*—Hill, Steadman & Simpson

[57] ABSTRACT

A sheet feed assembly for feeding sheets from a stack comprises a vacuum feed device which is movable to feed a sheet from the stack in the feed direction while the sheet is held on the feed device under vacuum. A sheet holding device is spaced from the vacuum feed device adjacent the stack in use for selectively preventing sheets from being fed from the stack. A control device coupled to the vacuum feed device and to the sheet holding device selectively supplies a vacuum to the vacuum feed device to cause the device to feed a sheet and, at substantially the same time, to deactivate the sheet holding device so as to allow a single sheet to be fed by the vacuum feed device.

67 Claims, 13 Drawing Sheets

TIMING DIAGRAM
TIME

VACUUM 0 PRESSURE
60
62
61

VACUUM 0 PRESSURE
63
64

DISPLACEMENT
FORWARDS 0 BEHIND

VOLTS
NOMINAL
PICK POINT
-180°
0°
35°
64°
70°
180°
DEGREES

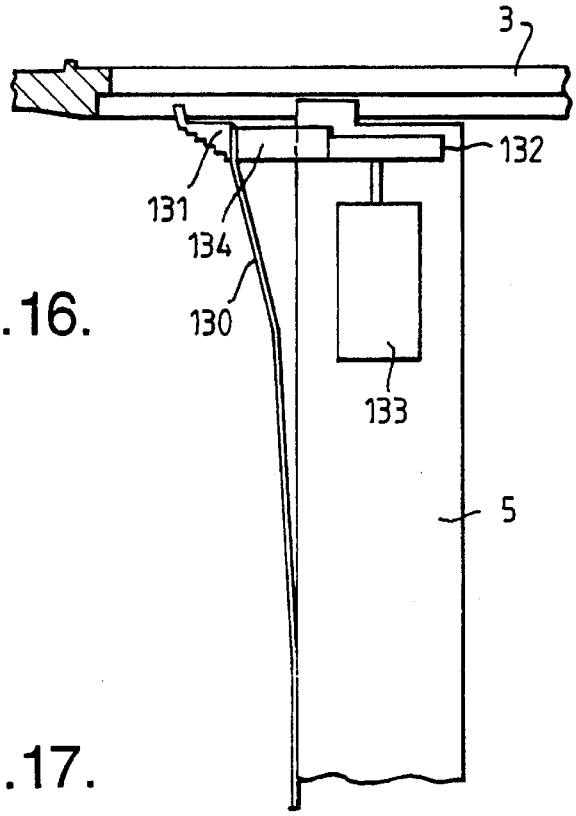
Fig.16.
Fig.17.
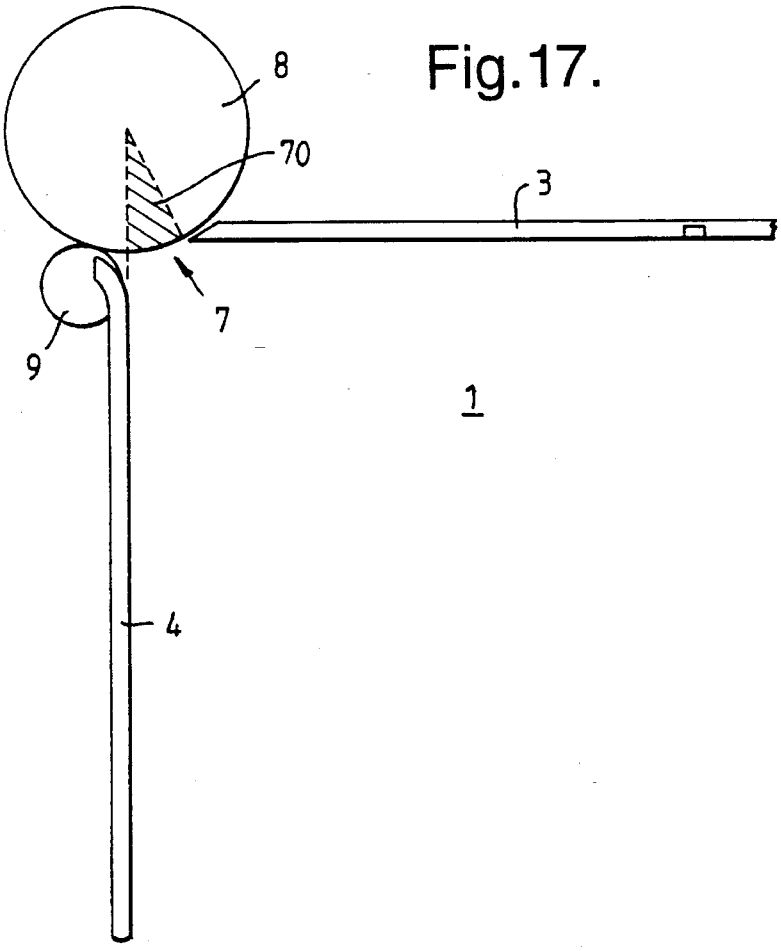

SHEET FEED AND PRESENTING ASSEMBLIES AND METHOD

BACKGROUND OF THE INVENTION

1. Field of the Invention

The invention relates to sheet feed and sheet presenting assemblies.

2. Description of the Prior Art

Sheet feed assemblies are used in a wide variety of fields to feed sheets from a stack. Examples include banknote dispensing and also photocopy paper dispensing. A known system for dispensing sheets from a stack makes use of a vacuum feed device, such as a rotatable wheel through which suction is applied selectively to draw a sheet from a stack upon rotation of the wheel. Examples of such devices are disclosed in U.S. Pat. No. 3,041,067, DE-A-3921582, and EP-A-0413471. In these assemblies, it is important to prevent sheets from inadvertently being fed or two sheets being fed at once. This problem is addressed in U.S. Pat. No. 3,041,067, for example, by providing an auxiliary holding device upstream of the vacuum feed device, to which vacuum is supplied. In use, vacuum is supplied both to the holding device and to the vacuum feed device, the vacuum force at the holding device being higher so that no sheets are fed. When it is desired to feed a sheet, pressure is additionally supplied to the holding device to reduce the overall vacuum force allowing a sheet to be drawn away.

A similar arrangement utilizing an additional holding device is described in DE-A-3921582. In this case, when the feed device has seized a sheet and starts to pull it away, the suction applied to the holding device is temporarily shut off so that the sheet can be removed.

SUMMARY OF THE INVENTION

The problem with both these earlier approaches is that they lead to a very noisy operation.

In accordance with one aspect of the present invention, a sheet feed assembly for feeding sheets from a stack comprises a vacuum feed device or means which is movable to feed a sheet from the stack in the feed direction while the sheet is held on the feed device under vacuum; a sheet holding device or means spaced from the vacuum feed device adjacent the stack in use for selectively preventing sheets from being fed from the stack; and a control device or means coupled to the vacuum feed device and to the sheet holding device to selectively supply a vacuum to the vacuum feed device to cause the device to feed a sheet and at substantially the same time to deactivate the sheet holding device by supplying air under pressure from the source to the sheet holding device so as to allow a single sheet to be fed by the vacuum feed device.

In accordance with a second aspect of the present invention, a method of feeding sheets from a stack using a sheet feed assembly comprising a vacuum feed device or means which is movable to feed a sheet from the stack in the feed direction while the sheet is held on the feed device under vacuum, and a sheet holding device or means spaced from the vacuum feed device adjacent the stack in use for selectively preventing sheets being fed from the stack comprises selectively supplying vacuum to the vacuum feed device to cause the device to feed a sheet and at substantially the same time deactivating the sheet holding device by supplying air under pressure from the source to the sheet holding device so as to allow a single sheet to be fed by the vacuum feed device.

We have realized that one of the major causes of the noise is the fact that there is an overlap period at which vacuum is applied both to the holding device and to the vacuum feed device and during which the leading end of a sheet is not fully held by the vacuum feed device. This means that the leading end flaps, rather like a musical reed generating significant noise. With the invention, however, the sheet holding device is not only deactivated at substantially the same time as vacuum is applied to the vacuum feed device to feed sheets but this deactivation is achieved by positively supplying air. This minimizes or avoids altogether the squeal effect, thus considerably reducing noise.

In some cases, the control device can supply air under pressure to the sheet holding device for the Whole time during which vacuum is supplied to the vacuum feed device, but, preferably, the control device supplies air under pressure for only part of the time during which a vacuum is supplied to the vacuum feed device. The advantage of this is to allow for faster re-establishment of the vacuum to the sheet holding device once the document being fed has its trailing edge clear of the sheet holding device.

Preferably, the control device supplies vacuum to the sheet holding device after vacuum ceases to be supplied to the vacuum feed device.

As a further assurance against sheets being inadvertently fed by the vacuum feed device, preferably, the assembly further comprises a source of air under pressure, the control device being adapted to supply air under pressure from the source to the vacuum feed device when vacuum is not supplied to the vacuum feed device.

A further problem which occurs with conventional vacuum feed devices is wear of the feed device surface.

In accordance with a third aspect of the present invention, a sheet feed assembly for feeding sheets from a stack comprises a vacuum feed device or means which is cyclically movable to feed a sheet from the stack in the feed direction while the sheet is held on the feed device under vacuum; a sheet holding device or means spaced from the vacuum feed device adjacent the stack in use for selectively preventing sheets from being fed from the stack; and a control device or means coupled to the vacuum feed device and to the sheet holding device to selectively supply a vacuum to the vacuum feed device to cause the device to feed a sheet and at substantially the same time to deactivate the sheet holding device so as to allow a single sheet to be fed by the vacuum feed device, whereby the control device controls the supply of vacuum to the feed device asynchronously with respect to the cyclic movement of the feed device.

In accordance with a fourth aspect of the present invention, a method of feeding sheets from a stack using a sheet feed assembly comprising a vacuum feed device or means which is cyclically movable to feed a sheet from the stack in the feed direction while the sheet is held on the feed device under vacuum, and a sheet holding device or means spaced from the vacuum feed device adjacent the stack in use for selectively preventing sheets being fed from the stack comprises selectively supplying vacuum to the vacuum feed device to cause the device to feed a sheet and at substantially the same time deactivating the sheet holding device so as to allow a single sheet to be fed by the vacuum feed device, whereby vacuum is supplied to the feed device asynchronously with respect to the cyclic movement of the feed device.

This aspect ensures that the vacuum feed device feeds notes at different times during its cyclic movement (e.g. rotation), thus minimizing wear.

Typically, the vacuum feed device will feed sheets to a transport system at substantially the same speed as they are transported by the transport system.

In order to improve the presentation of sheets in a stack to the vacuum feed device, preferably the apparatus further comprises a nudging device or means positioned between the vacuum feed device and the sheet holding device; and a controller for causing the nudging device periodically to move into engagement with a leading sheet in the stack, to nudge the sheet in the feed direction, and then to retract away from the sheet. Preferably, the action of the nudging device would be timed to occur when a sheet is being fed by the vacuum feed device.

Conveniently, the assembly further comprises a support member (e.g. a plate) against which the stack is urged in use, the support member having a depressed section adjacent the vacuum feed device; and an auxiliary suction device or means for communicating an auxiliary vacuum through the depressed or recessed section of the support member. This provides a means by which the sheet to be fed is drawn forward to be in contact with the nudging device when provided. Typically, the auxiliary vacuum will be less than the vacuum applied to the vacuum feed device.

This arrangement is particularly suitable for using in combination with the nudging device where the nudging device engages with the leading sheet through an aperture in the depressed section of the support member. The nudging device causes the leading sheet to be lifted off the support member as the nudging device comes forward, thereby breaking the vacuum seal between the sheet and the support member. Typically, the nudging device will be faced with a high friction surface and will be replaceable.

The vacuum feed device or means may take any conventional form and typically includes a rotatable member having a plurality of holes or grooves around its circumference, and an internal porting member about which the rotatable member rotates, and having an outlet which communicates with one or a number of the plurality of holes or grooves of the rotatable member.

Similarly, the control device or means can take any conventional form but, preferably, comprises a pair of valves each having two input ports coupled in use to sources of vacuum and pressure, respectively, and an output port which is selectively connectable to either one of the input ports. In the case where it is desired to supply pressure on occasion to the vacuum feed device, the apparatus further comprises a fluid control valve which causes pressure to be continuously supplied to the two input ports of the valve connected to the vacuum feed device when it is desired not to feed a sheet.

Most preferably, the valve connected to the vacuum feed device is mounted concentrically with the rotatable member in order to keep air passages short.

An important requirement of sheet feed systems is to ensure that sheets are presented in an optimum manner to the sheet feed device. This is a particular problem with poor quality sheets, such as used banknotes and the like. U.S. Pat. No. 4,653,742 discloses various types of nudging devices positioned at the rear end of the sheets but these have a fairly simple construction and are not well suited to separate sheets in the stack.

In accordance with a fifth aspect of the present invention, a sheet presenting assembly for presenting a stack of sheets to a sheet feed device which withdraws sheets from the stack through a sheet exit comprises a support member towards which the faces of sheets in a stack are urged, the sheet exit being positioned at one end of the support member; a biasing member or means for urging the sheet stack towards the support member; a first sheet guide wall extending in the urging direction alongside the sheet stack towards the support member and terminating at a position spaced from the support member to define the sheet exit; and a second guide wall laterally spaced from the first guide wall and extending toward the support member whereby a stack of sheets is positioned between the first and second guide walls in use, at least one of the first and second guide walls being shaped adjacent the support plate to extend in the sheet exit direction.

The overlapping or shingling of the sheets may occur under gravity due to the orientation of the sheets but typically the assembly further comprises means for vibrating at least the sheets near the support member in such a way that they are urged to take up an overlapping arrangement in the sheet exit direction by a shaped part or parts which may be either separated parts or a portion of each of the first and second guide walls. Typically, the second guide member includes a wall section adjacent the support member, the wall section presenting at least two steps facing generally towards the sheet exit which engage trailing ends of sheets in use whereby as sheets approach the support plate under the biasing action, their trailing edges engage the wall section of the second guide member so that the sheets are urged successively nearer the sheet exit. This aspect of the invention neatly shingles the sheets at the leading end of the stack towards the sheet exit so that they can be cleanly picked up by the sheet feed device.

Preferably, the wall section extends generally linearly towards the sheet exit as it approaches the support member. This helps to increase the degree of shingling at the leading end of the stack. It also allows the remainder of the second guide wall to be spaced further from the first guide wall, thus making it easier to load notes.

In order to minimize the risk of more than one sheet being fed, conveniently, the steps are provided only in a region of the wall section near the support member.

Typically, the wall section comprises a resilient arm, and the vibrating means comprises a motor and an eccentric cam rotated by the motor to cause the resilient arm to vibrate.

The vibrating wall section could vibrate along the surface of the support member, but, preferably, the wall section overlaps the support member so that no sheets can move laterally away from the sheet exit. In this case, preferably, the surface of the part of the wall section overlapping the support member and facing the sheet exit is at an obtuse angle to the support member.

The wall section can either comprise an integral part of the remainder of the second guide wall or be formed as a separate item, preferably connected to the remainder of the second guide wall.

We have also devised, in accordance with a sixth aspect of the present invention, a sheet presenting assembly for holding a stack of sheets and for use with a sheet feed device for withdrawing sheets from the stack through a sheet exit, the sheet presenting assembly comprising a base, which may be either substantially horizontal or inclined up to 30° to the horizontal, on which edges of sheets are attacked in use; a support member at one end of the base towards which the faces of the sheets are urged by biasing means; and an oscillating device for oscillating the base in a plane of the base relative to the support member.

Preferably, the oscillation frequency is in the order of 3–15Hz.

As previously mentioned, the invention can be utilized with various different types of sheets, including banknotes and other paper, card and the like.

BRIEF DESCRIPTION OF THE DRAWINGS

An example of a sheet feed assembly and a sheet presenting assembly according to the invention will now be described with reference to the accompanying drawings, in which:

FIG. 16 is a partial side view with portions broken away illustrating the vibrating arm in more detail;

FIG. 17 is a schematic side view of the assembly;

DETAILED DESCRIPTION OF THE PREFERRED EMBODIMENTS

Figure 1:
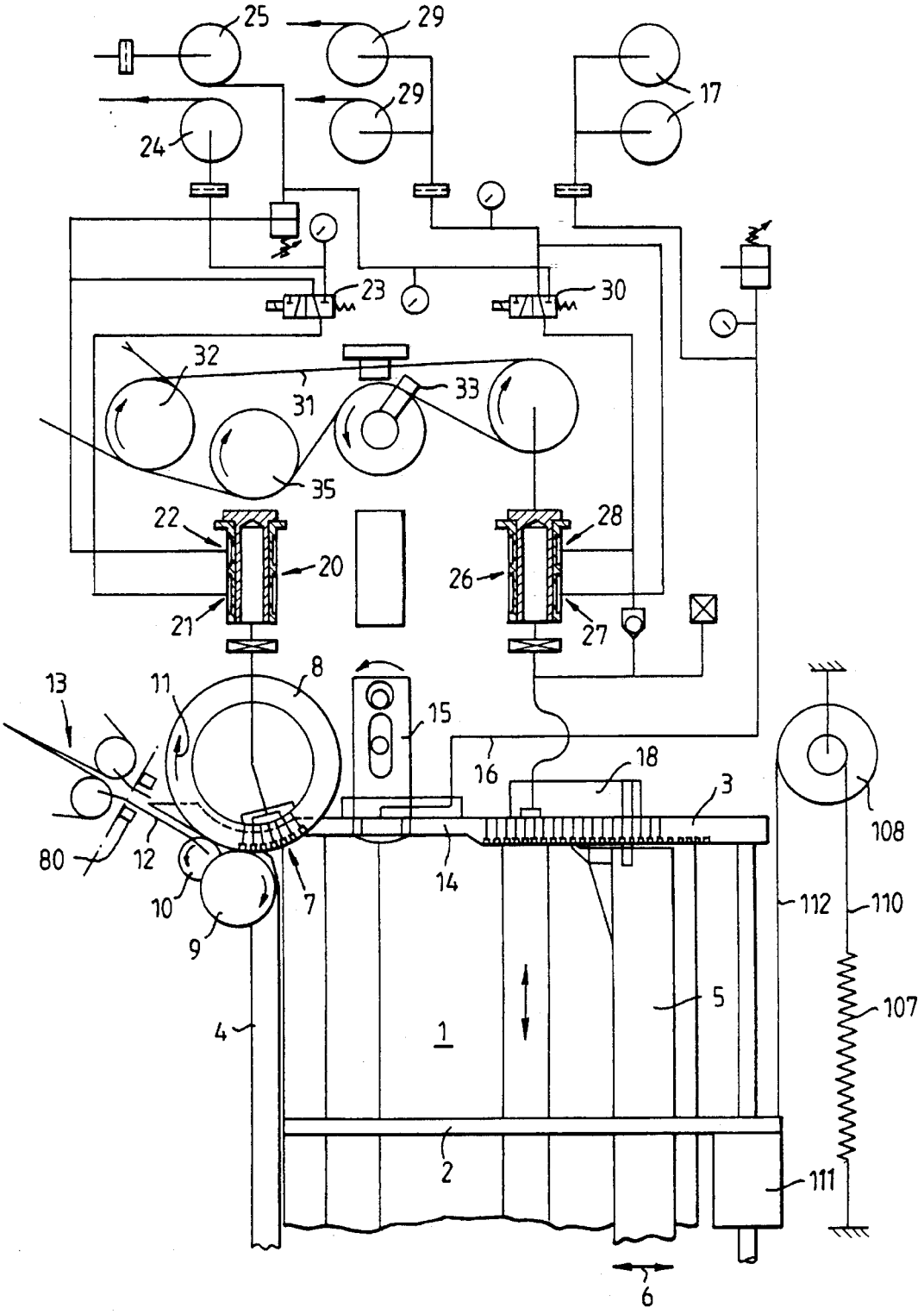
FIG. 1 is a schematic and diagrammatic view of the assemblies.

The assembly is shown partly in plan in FIG. 1 and partly schematically and includes a banknote tray 1 on which banknotes are stacked on their long edges in use for feeding to downstream sorting or dispensing apparatus (not shown). The notes are positioned behind a paddle 2 which is urged towards the banknote stack (not shown) and, thus, urges the stack against an upright support plate or face plate 3. A fixed guide wall 4 extends along one side of the note tray 1 while a laterally movable guide plate 5 extends parallel with the wall 4 and is movable in the directions of the arrows 6 to accommodate different note lengths. The junction between the face plate 3 and the wall 4 defines a sheet exit opening 7 at which is positioned a peeler wheel 8, a contra-rotating roller 9 and a pinch wheel 10. The roller 9 and wheel 10 are driven in a conventional manner by means not shown. As will be described in more detail below, the peeler wheel 8 is rotatable in the direction of the arrow 11 and is supplied with vacuum which passes through the apertures in the peeler wheel so that a leading sheet in the stack is sucked against the surface of the peeler wheel 8 at the sheet exit and rotation of the peeler wheel 8 draws the sheet through the sheet exit and feeds it between guides 12 past a sensor 80 to a transport system shown schematically at 13.

The face plate 3 has a reduced thickness or depressed section 14 through which a nudger assembly 15 can protrude as will be described in more detail below. In addition, suction force (less than that supplied to the peeler wheel 8) is supplied through the reduced section 14 via a conduit 16 from vacuum pumps 17.

A sheet holding device 18 is mounted to the rear surface of the face plate 3 and is adjustable with the guide wall 5 along the face plate 3. The sheet holding device or means 18 is selectively supplied with a vacuum as will be described below to hold the leading sheet in the stack at its trailing end.

A rotary control valve 20 is coupled with the peeler wheel 8 as will be described in more detail below and is supplied at one input port 21 with either vacuum or air under pressure and at its other input port 22 continuously with air under pressure. The supply to the input port 21 is controlled by a solenoid operated control valve 23 having input ports connected to a vacuum pump 24 and to a pressure pump 25. The pump 25 is also connected directly to the input port 22 of the rotary control valve 20.

The sheet holding device 18 is connected to a rotary control valve 26 having a similar construction to the rotary control valve 20. The rotary control valve 26 has a pair of input ports 27, 28, the input port 27 being continuously connected to vacuum pumps 29 and the input port 28 being connected via a solenoid operated control valve 30 to either the pressure pump 25 or to the vacuum pumps 29.

The positions of the rotary control valves 20, 26 and the nudger assembly 15 are controlled from a toothed drive belt 31 driven from a drive roller 32 driven by a stepper motor (not shown). The nudging assembly 15 includes a rotary encoder 33 so that rotation of the components can be monitored.

Figure 3:
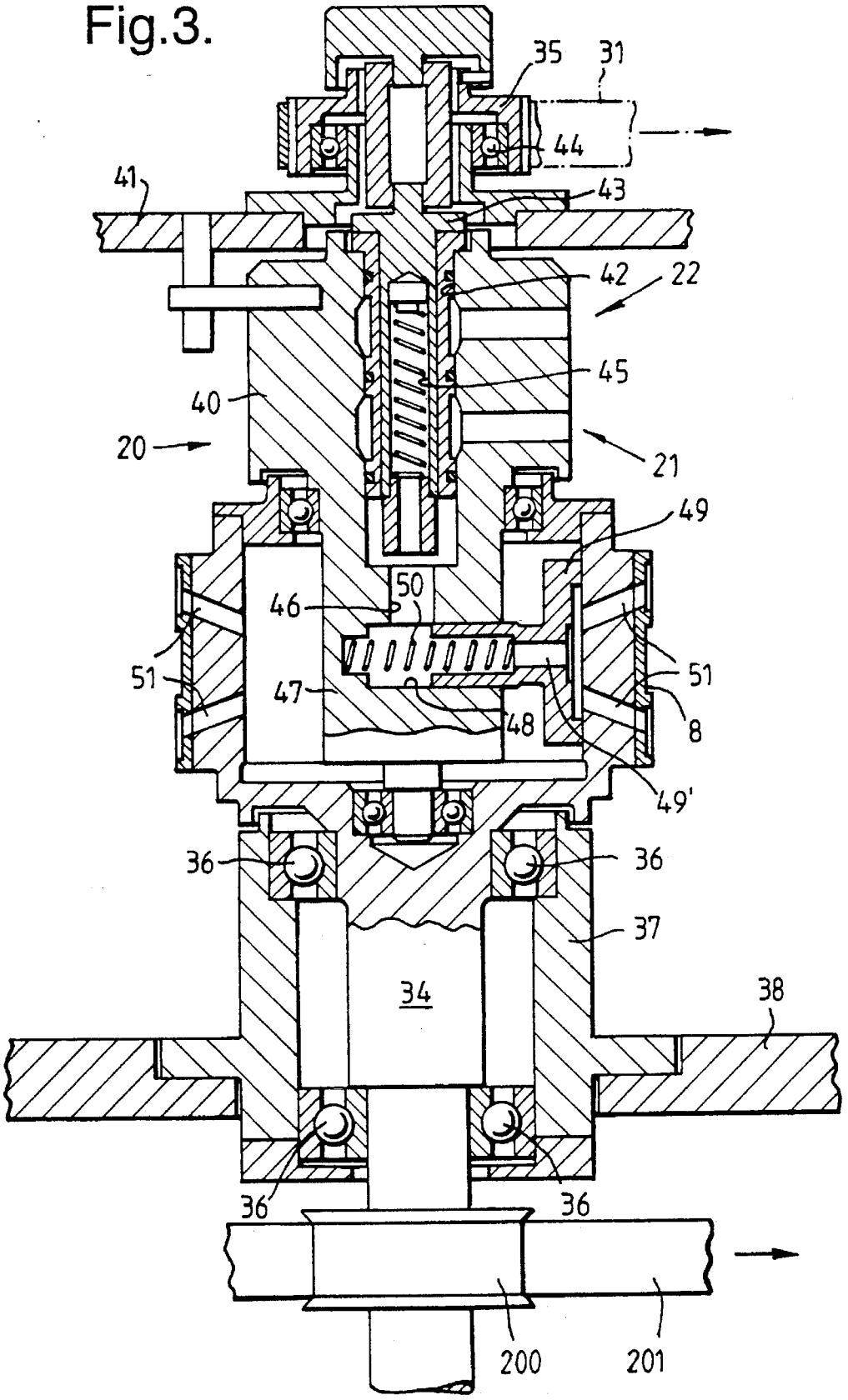
FIG. 3 is a longitudinal cross-sectional view through the peeler wheel and rotary valve construction.

The construction of the rotary control valve 20 and peeler wheel 8 is shown in more detail in FIG. 3. As can be seen in FIG. 3, the peeler wheel 8 is integrally formed with a shaft 34 carrying a pulley 200 about which a drive belt 201 is entrained. The shaft 34 is mounted in bearings 36 supported in a bearing housing 37 which is mounted on a base plate 38. The drive belt 201 is driven by the transport system 13 via an overload protection clutch (not shown).

The rotary valve 20 is mounted to be concentrically aligned with the peeler wheel 8. The valve has a casing 40 which is fixed, as shown, to a support plate 41 and defines a valve bore 42. A rotary valve member 43 is supported via bearings in the bore 42 and is rotated by the drive belt 31 via a drive pulley 35 supported by bearings 44 on the support plate 41. To isolate the valve from side loads resulting from belt tension and drive torques, the pulley 35 is mounted on its own bearing, and a coupling rotationally links the pulley to the valve. The pulley bearing housing is mounted directly to the rotary valve drive support plate. This avoids passing any run out tolerance from the peeler wheel and the valve body assembly into the rotary valve drive belt system.

The valve member 43 has a bore 45 which extends into a bore 46 of a valve casing extension 47 of the casing 40. The extension 47 includes a bore 48 extending at right angles to the bore 46 and supporting slidably a shoe 49 which is urged to the right, as seen in FIG. 3, via a compression spring 50. The shoe 49 conveys vacuum or air under pressure supplied through the bore 49' to a small section of the peeler wheel slots or bores 51, as will be explained below. The rotary position of the shoe 49 can be adjusted by rotating the valve casing 40 and refixing it to the plate 41 as required.

Figure 4:
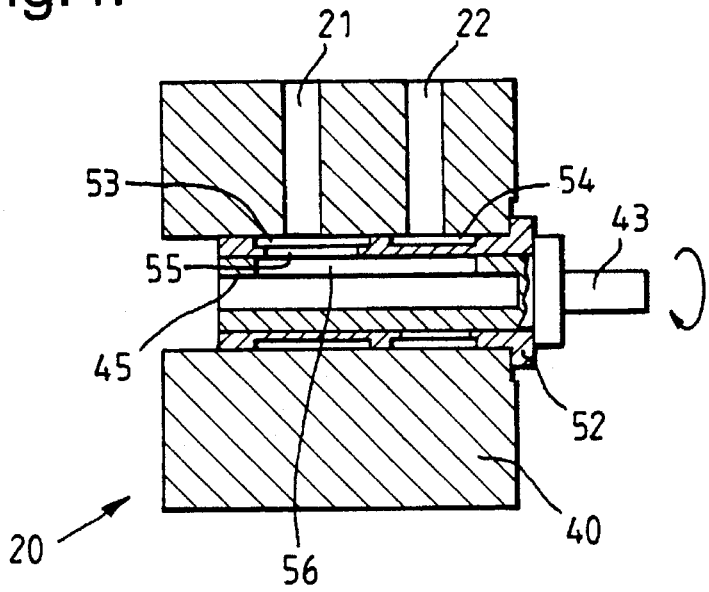
FIG. 4 is a cross-sectional view through the rotary valve in more detail.

FIG. 4 illustrates the construction of the rotary valve 20 in more detail. As can be seen, the valve includes a sleeve 52 having two annular grooves 53, 54 machined into its outer circumference and pressed into the valve casing 40. The annular grooves 53, 54 are aligned with ports 21, 22, respectively. Radial holes and/or slots 55 are machined at selected positions around the bottoms of the sleeve grooves, through to the bore of the sleeve. Preferably, the holes or slots in the pressure groove 54 are at a different radial position to those for the vacuum groove 53. The angle between the holes or slots provided in the two grooves determines when vacuum or pressure will be applied to the peeler wheel 8 via the valve bore 45.

The valve member 43 consists of a bored cylindrical block into which a longitudinal slot 56 is machined. This slot 56 will communicate with the holes or slots in the sleeve 53 to apply vacuum or pressure to the valve bore 45 depending on its rotational position and the position of the holes or slots in the sleeve.

The rotary valve member 43 is designed such that it can be withdrawn from the valve body/sleeve assembly without the need to disassemble the pulley and drive belt (see FIG. 3). This means that the valve member may easily be withdrawn and replaced for the purpose of routine cleaning without upsetting the valve timing.

Figure 6:
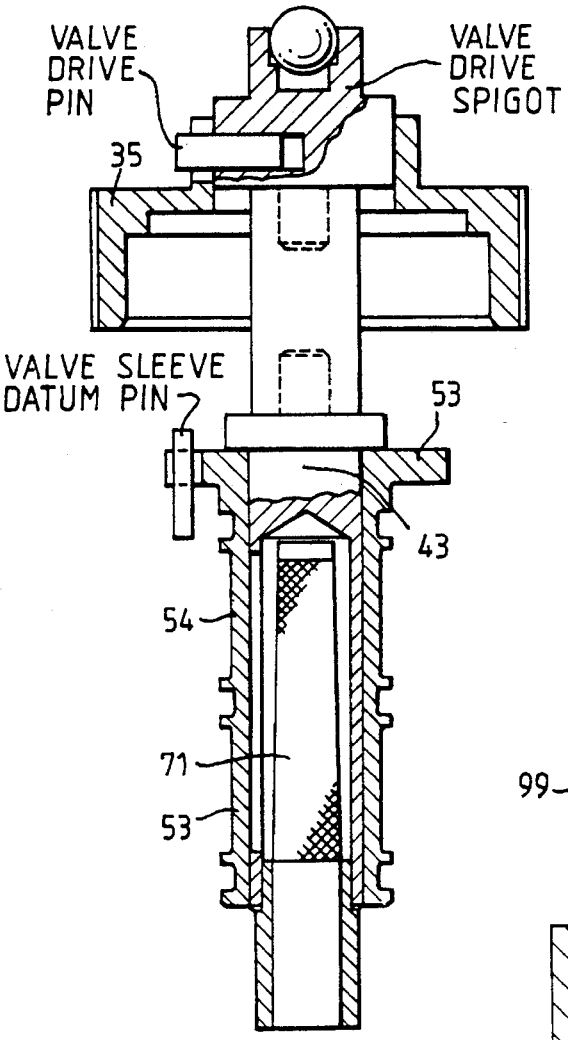
FIG. 6 is a longitudinal cross-sectional view through the rotary valve assembly.

Removal of the valve member 43 allows access to a small stainless steel mesh filter 71 (FIG. 6) which is fitted to the end of the valve. This filter can then easily be shaken/blown clean, washed in degreasing agent or replaced.

The mesh filter 71 is designed to prevent large particles of debris from being drawn into the valve porting area. In normal operation, while feeding notes, the bidirectional air flow will be generally in the direction from the valve ports to the slots of the peeler wheel 8 or vacuum pad 18. The system will, thus, be self-cleaning as note debris will be ejected into the feeder note tray, where it can be easily removed.

In addition, two filters (not shown) are provided to protect the vacuum pump and the blower. In the case of the vacuum pump filter, the volume in the filter acts as a small reservoir to attenuate pumping flow fluctuations. It is anticipated that replacement of the pump protection filters will be at service interval or longer.

It will be understood that the construction of the rotary valve 26 is substantially identical with that of the rotary valve 20.

The operation of the assembly as described so far will now be outlined. Initially, the transport system 13 is activated and the drive belt 31 is activated to cause the rotary control valves 20, 26 to run at the correct speed to give the required feed rate. It should be noted here that the peeler wheel 8 is geared directly to the transport 13 such that the surface speed at the periphery of the peeler wheel is equal to the speed at which the notes travel in the transport. Also, the vacuum pumps and air pumps 17, 24, 25 and 29 must establish the correct vacuum/pressure. Finally, notes must be present on the tray 1.

Until all these conditions are attained, the two solenoid control valves 23, 30 are set to prevent note feeding. Thus, air pressure is fed to the peeler wheel 8 to prevent notes from being pulled into the transport. This air pressure is kept to a minimum so that there is sufficient positive air flow to purge the opened peeler porting of dust whilst, when the peeler wheel is switched to vacuum, enabling as rapid rate of rise in vacuum as possible. Air from the air pump 25 is passed to the input port 22 of the rotary valve and via control valve 23 to input port 21 so that air pressure passes to the peeler wheel 8. In that condition, the input port 21 is closed.

Also, when notes are not being fed, the control valve 30 supplies vacuum from the pumps 29 directly to the sheet holding device 18 and to the input ports 27, 28 of the rotary control valve 26. In this way, at least a leading sheet in a stack on the tray 1 is sucked against the face plate 3.

Figures 2A, 2B, 2C, 2D:
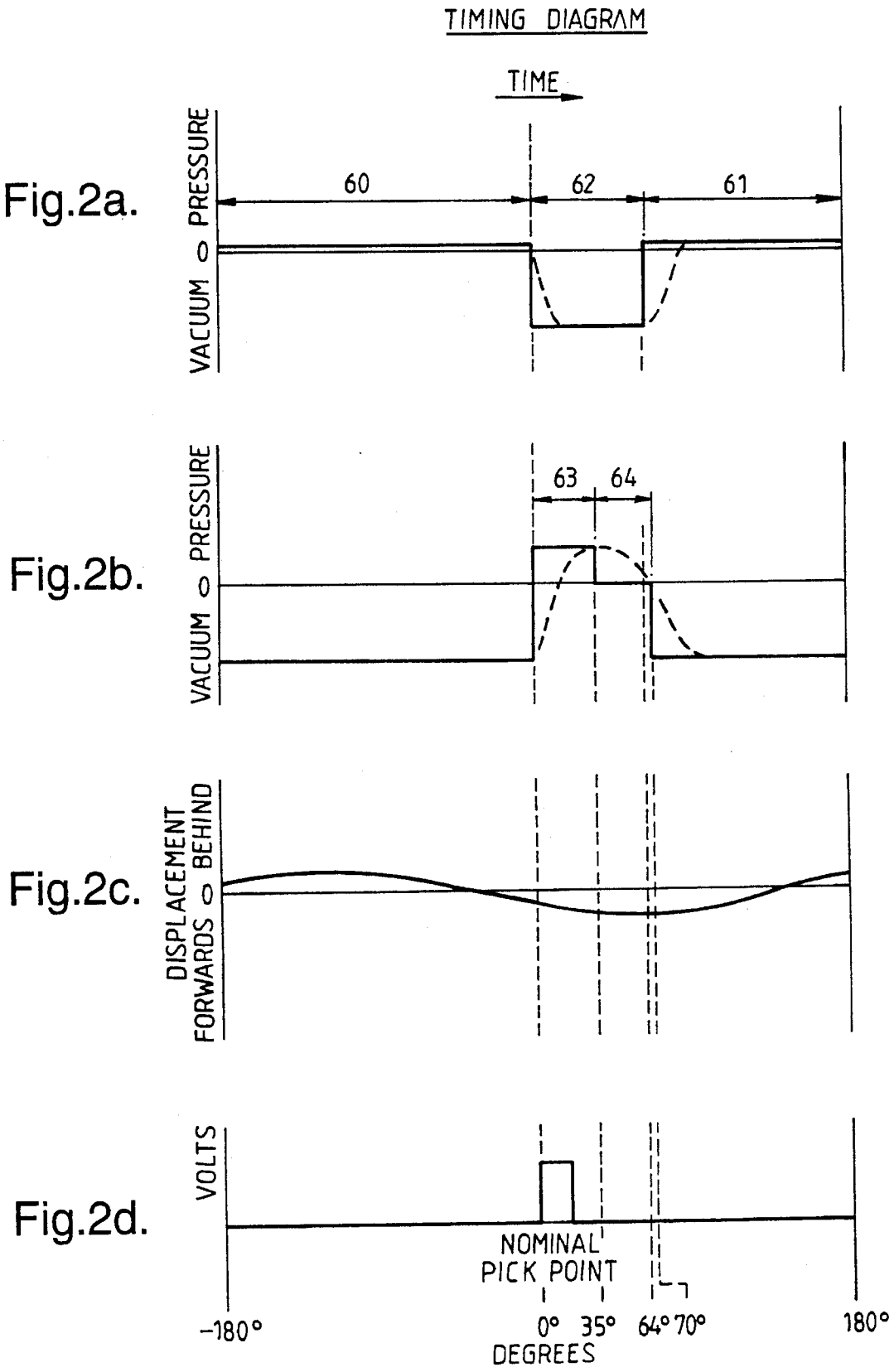
FIGS. 2*a*–2*d* are timing diagrams illustrating the supply of vacuum and air to the peeler wheel, the supply of vacuum and air to the sheet holding device, movement of the nudger assembly, and the signal from the nudger assembly encoder, respectively.

FIG. 2*a* illustrates the timing of the supply of pressure and vacuum to the peeler wheel 8 and the period during which no sheet is fed is indicated by sections 60 and 61. FIG. 2*b* illustrates that during these periods, vacuum is being supplied to the sheet holding device 18.

When the conditions for commencement of feeding are met, the solenoid control valves 23, 30 are activated so that notes are fed. These valves remain in this state for the whole time during which the feeding of notes is required, i.e., they do not need to switch on and off for every note fed. In this situation, air pressure is supplied to the port 28 of rotary control valve 26 and vacuum is supplied to the port 21 of the rotary control valve 20.

The control of the sequence of switching alternating vacuum and pressure into the peeler wheel picking slots 51 and the sheet holding device or vacuum pad 18 is achieved by the two rotary control valves 20, 26. These valves are driven in a set angular relationship to one another, as can be seen from the timing diagram in FIGS. 2*a* and 2*b*. Control of the rotation is, as explained above, achieved by the belt 31. The solid lines in FIGS. 2*a* and 2*b* illustrate the ideal condition. In practice, the application and removal of vacuum and pressure will take a finite time and this is illustrated by the broken lines.

Thus, once the solenoid control valves 23, 30 have been adjusted, rotation of the valve member of the rotary valve 20 will cause vacuum periodically to be transmitted to the peeler wheel 8 instead of air pressure. This occurs during a period 62, as seen in FIG. 2*a*. During this period, the port 22 is closed and the port 21 open.

Similarly, the rotary valve 26 will be controlled to pass air under pressure supplied to the port 28 to the sheet holding device 18 during (part of) a period 63 which is shorter than the period 62. It will be noted, in particular, that the period 63 commences simultaneously with the period 62. During a period 64, neither vacuum nor pressure will be supplied to the sheet holding device 18, since both ports 27, 28 of the rotary control valve 26 will be closed. At the end of the period 64, which shortly follows the end of the period 62, pressure will be supplied to the peeler wheel 8 and vacuum to the sheet holding device 18.

During the period 62, the leading sheet in the stack will be sucked against the peeler wheel 8 and drawn out of the stack and fed into the sheet transport 13. The period 62 is relatively short compared with the time it takes to fully extract a sheet. Also, the sheet holding device 18 relatively quickly (at the end of the period 64) acts to suck the next sheet in the stack against the face plate 3, thereby minimizing the risk of that sheet also being fed with the first sheet. However, since vacuum supply to the sheet holding device 18 terminates as vacuum is supplied to the peeler wheel 8, the "reed" effect described above is avoided.

One note is fed for each revolution of the rotary control valve 20. However, modifying the arrangement of slots and holes within the assemblies 20, 26 will enable more than one note to be fed per revolution.

If the rotary control valves 20, 26 should vary their speed or stall, the note timing would be altered with serious consequences. Therefore, the rotary encoder 33 (for example an optical encoder or Hall effect vane switch) is attached to the rotary valve drive train to monitor the rotation speed. The encoder 33 is preferably a single pulse per revolution device. The timing of the front edge of the encoder pulse (sync pulse) is adjusted, as shown in FIG. 2*d*, such that it is in phase with the pick point (commencement of periods 62 and 63) and can be sent to the transport control electronics.

As already described with reference to FIG. 3, air or vacuum is supplied to the peeler wheel 8 via the shoe 49 which forms an airtight seal with the peeler wheel 8. The angular position of the shoe 49 determines where a note is picked and this can be adjusted as described.

Figure 5:
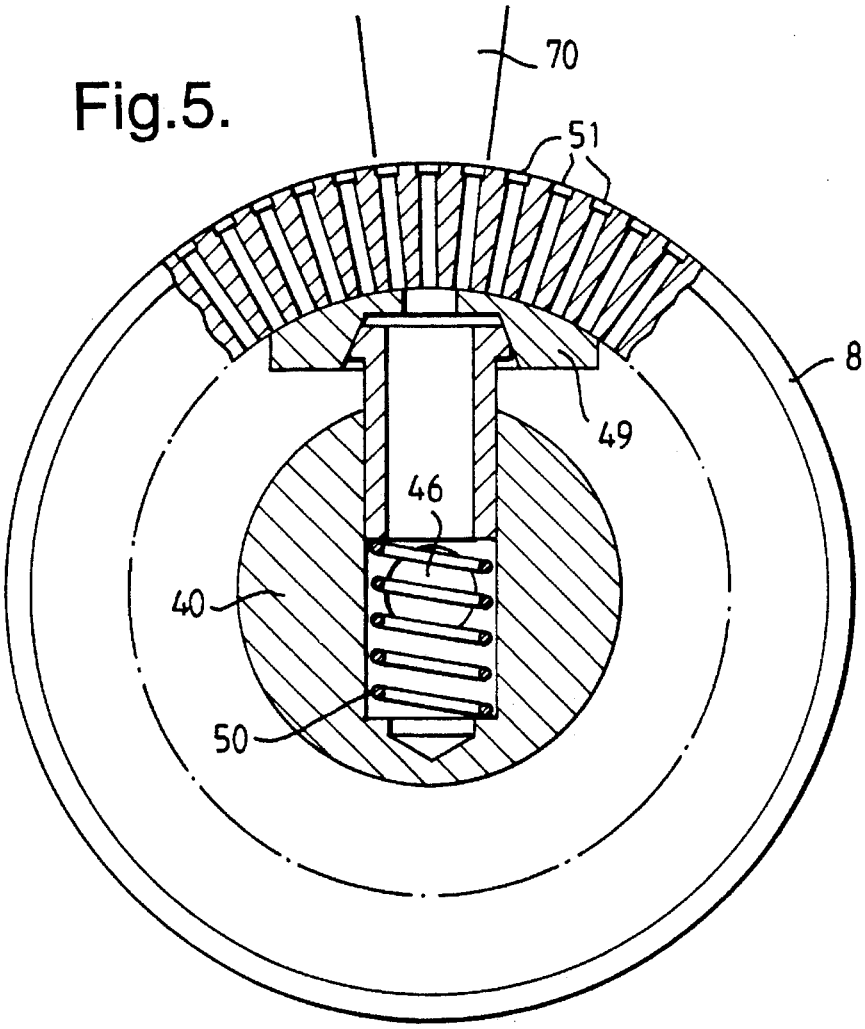
FIG. 5 is a partly cut-away view of the peeler wheel.

The peeler wheel 8 and shoe 49 are shown in plan and partial cross-section in FIG. 5. The peeler wheel 8 has a high friction surface and a series of radially outwardly extending slots or holes 51 arranged at equal angular pitches around the complete circumference of the wheel. The high friction surface may be a rubber coating.

The rotary valve assembly 20 is mounted to the peeler wheel 8 in order to minimize the volume of air communicating through the slots 51 to the rotary valve porting. This is important because the air flow to the slots is bidirectional.

As can be seen in FIG. 5, the shoe 49 defines those slots 51 which will receive vacuum or air under pressure and, thus, define a note pick section 70. FIG. 17 illustrates the relationship between the note pick section 70 and the tray 1 and sheet exit 7.

Preferably, and according to an important aspect of the invention, the rotary valves 20, 26 are not rotated at the same rpm as the peeler wheel 8 in order that the note picking section 70 on the peeler wheel surface occurs at a different point on the surface for each note fed, thus reducing the wear rate on that surface.

Figure 7:
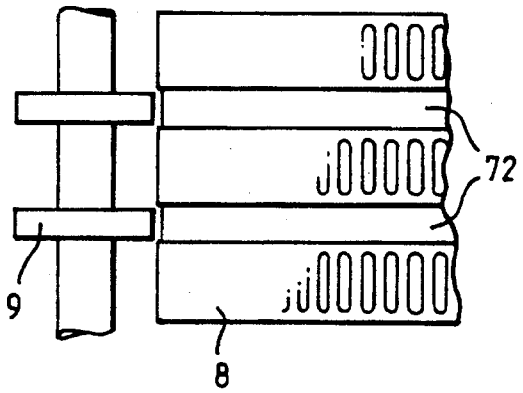
FIG. 7 is a partial elevational view illustrating the peeler wheel and contra-roller arrangement.
Figure 8:
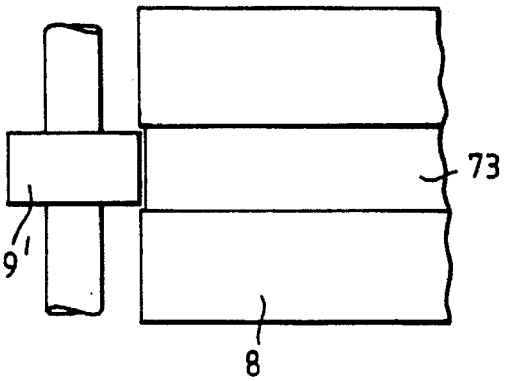
FIG. 8 is a view similar to FIG. 7 but showing a modified arrangement.
Figure 9:
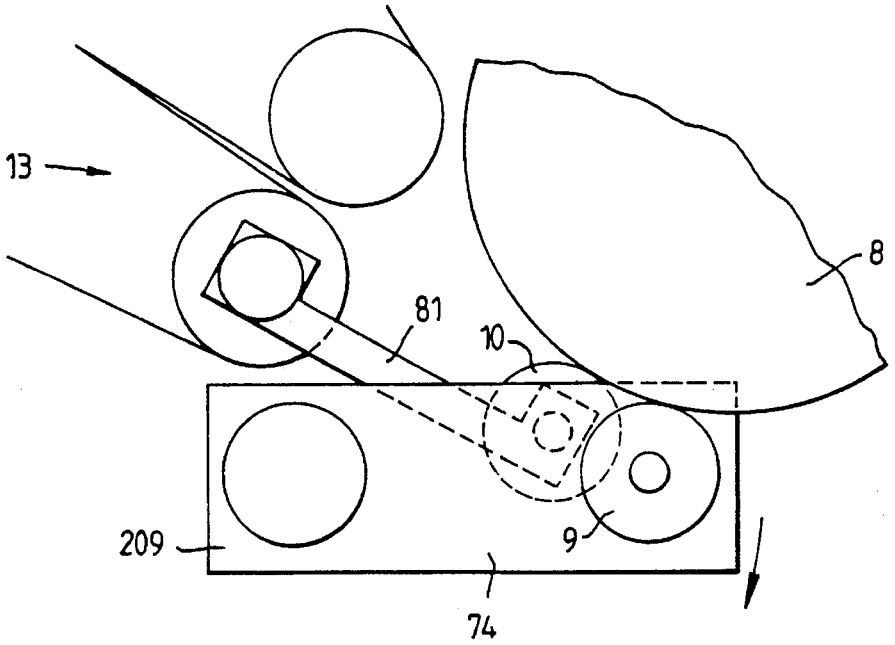
FIG. 9 is a partial side view illustrating the mounting of the contra and pinch rollers relative to the peeler wheel.

FIG. 7 illustrates the relationship between the contra-roller 9 and the peeler wheel 8 in more detail where it can be seen that the contra-roller comprises two roller portions aligned with respective circumferential grooves 72 in the peeler wheel 8. In FIG. 8, a single contra-roller 9' is provided aligned with a single central circumferential groove 73 on the peeler wheel 8. The contra-roller 9 or 9' rotates very slowly against the direction of note feeding and this prevents uneven wear patterns from developing on the contra-roller. The contra-roller 9 or 9' is small in diameter and is mounted in a yoke 74 (FIG. 9) which allows it to be moved to a position where it may easily be removed and replaced.

Figure 10:
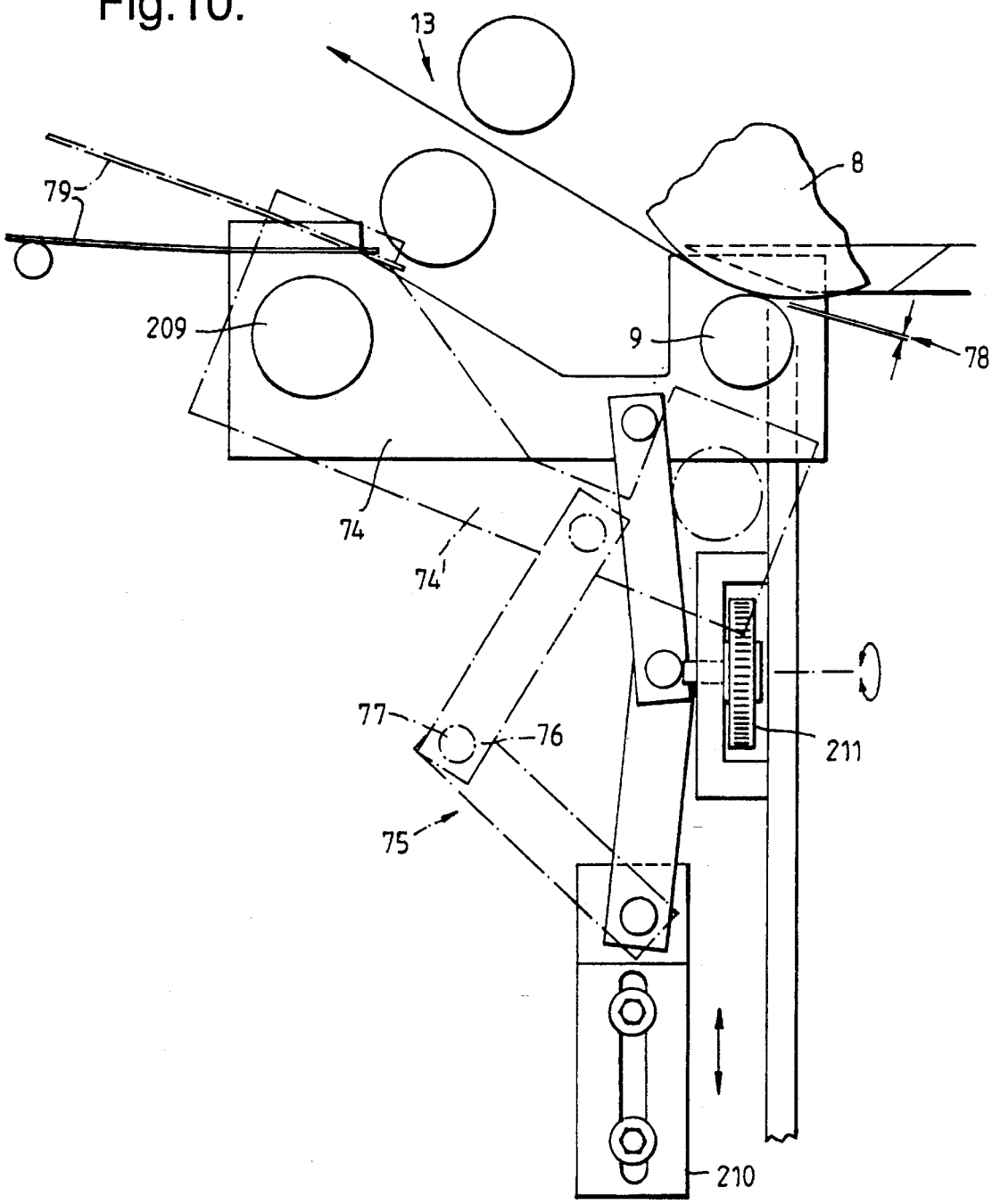
FIG. 10 is a partial side view illustrating the mounting arrangement of the contra-roller.

FIG. 10 shows a mechanism whereby the contra-roller mounting yoke 74 may be pivoted backwards about a post or axle 209 to a position 74' using a toggle clamp 75. The coarse position of the toggle clamp is controlled by a sliding mechanism 210 and the fine position by a knurled adjustment wheel 211.

The operator can conveniently move the contra-roller 9 back by moving a pivot beam center rod 76. A small knob 77 is provided. The contra-roller 9 may be moved back and replaced using the toggle knob 77 without disturbing the gap setting 78 between the contra-roller 9 and the peeler wheel 8. This mechanism allows the operator to open the contra-roller/peeler wheel gap to clear any notes that may have become jammed.

A beam spring 79 is mounted to the yoke 74 to cause a load against which the toggle clamp can lock. The beam spring 79 acts during the last two millimeters of gap closure.

Once a note is picked by the peeler wheel 8 and pulled past the contra-roller 9, it passes under a pinch roller 10. The pinch roller 10 presses the note against the peeler wheel 8 and ensures that it is positively fed into the transport belts of the system 13 (see FIG. 9). Although only a single pinch wheel 10 is shown, in general, there will be a pair of pinch wheels, each independently spring loaded against the peeler wheel 8. The pair of pinch wheels 10 serve to accelerate the notes to transport speed.

The pinch roller 10 is mounted on a spring loaded arm 81. The force exerted by the spring may be set as required.

Figure 11:
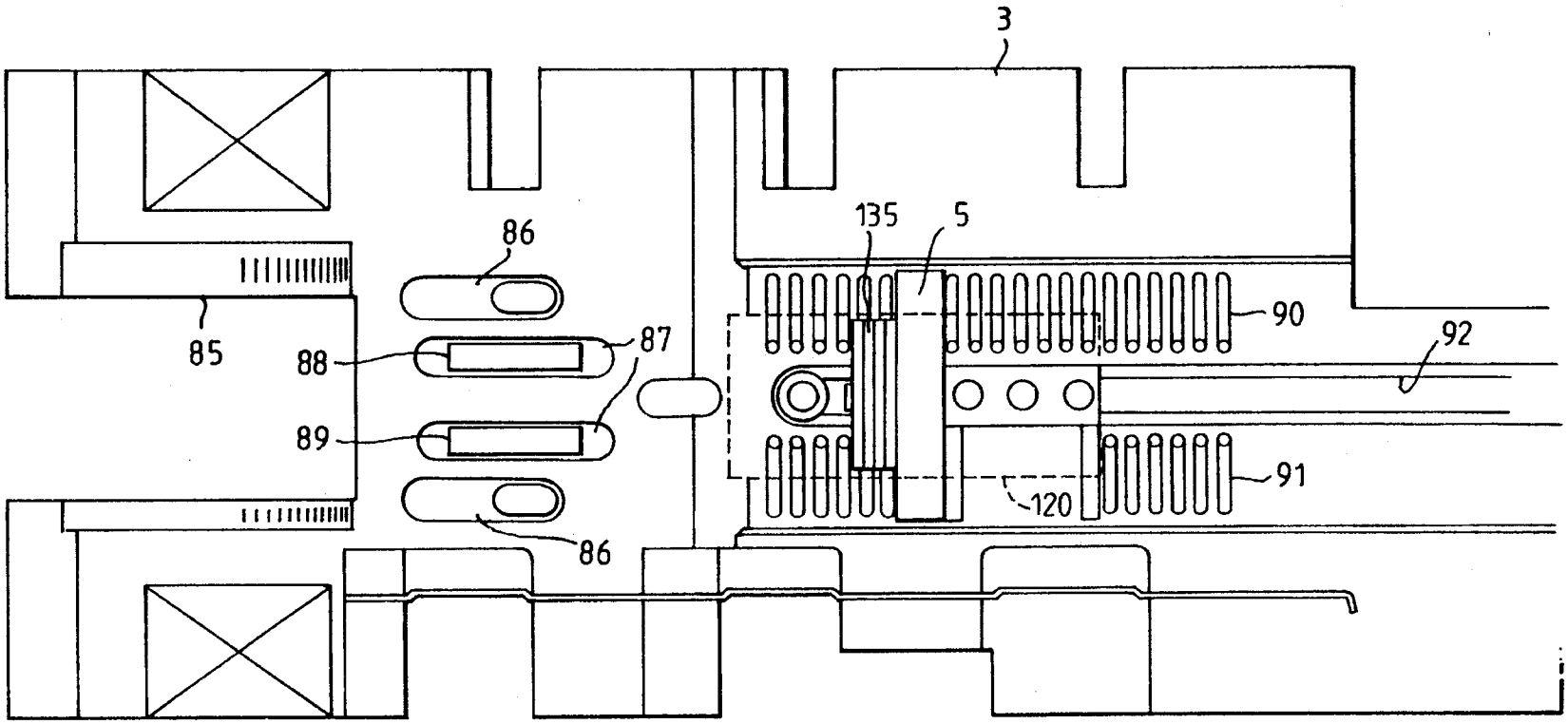
FIG. 11 is a bottom plan view of the face plate.

FIG. 11 illustrates the face plate 3 in more detail. The face plate 3 has a generally rectangular form with an aperture 85 through which the peeler wheel 8 protrudes in use. Next to the aperture 85 are a pair of upper and lower elongate apertures 86 which are supplied with vacuum via the conduit 16 and a pair of upper and lower apertures 87 between the apertures 86 through which protrude respective arms 88, 89 of the nudging assembly 15.

Figure 12:
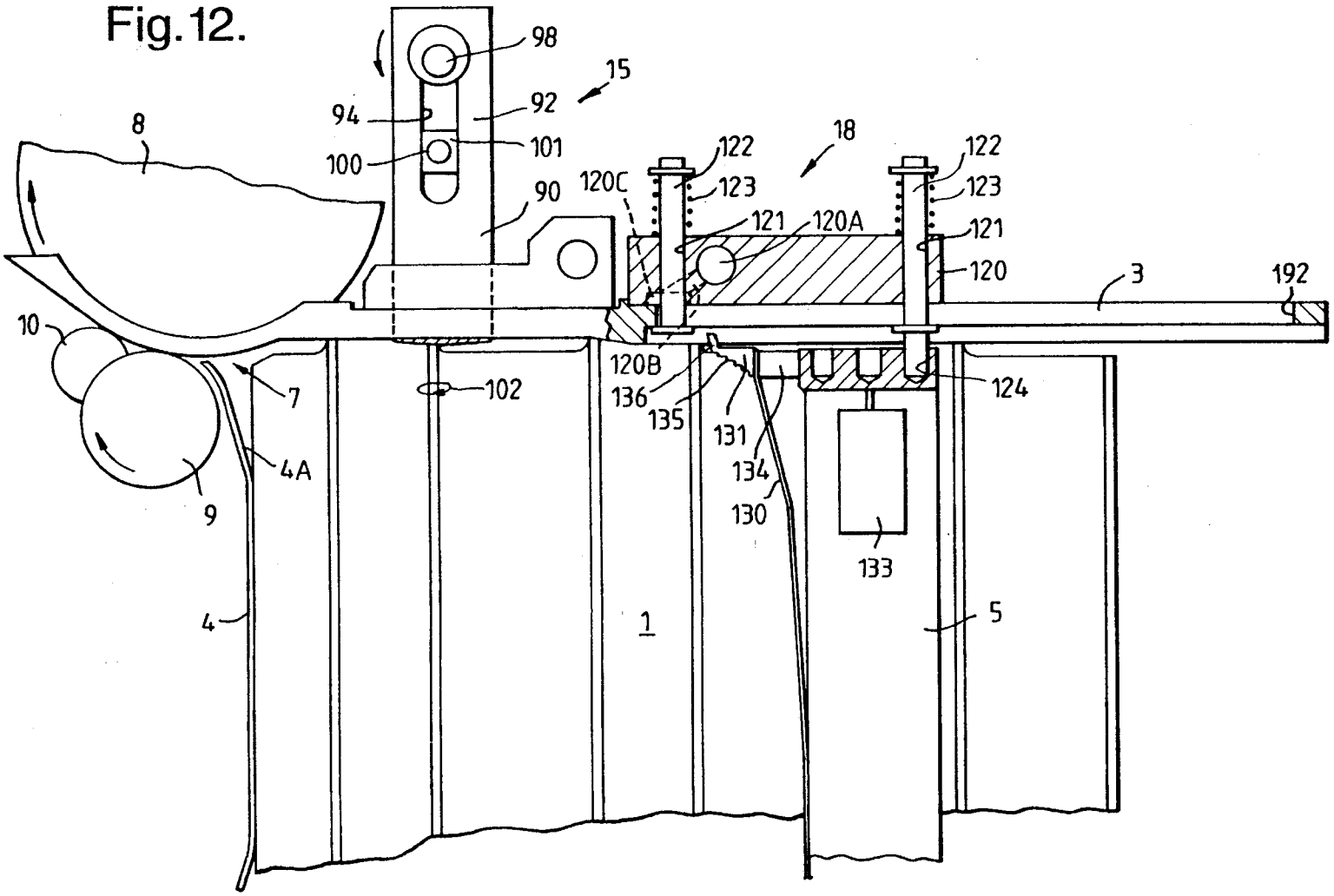
FIG. 12 is a partial side view with portions broken away of the assembly.

Laterally offset to the right, as seen in FIG. 11, are sets of upper and lower apertures 190, 191 through a selected number of which vacuum or pressure is communicated from the sheet holding device 18, and an elongate slot 192 through which the sheet holding device 18 is secured to the face plate 3 but along which it can be slid as required. Since the vacuum supplied by the sheet holding device 18 must only act on the last 20–30 mm of a note, it is necessary to be able to adjust the position of the sheet holding device for different length notes. FIG. 12 illustrates the mounting arrangement of the sheet holding device 18, peeler wheel 8 and nudging assembly 15 in more detail.

Figure 13:
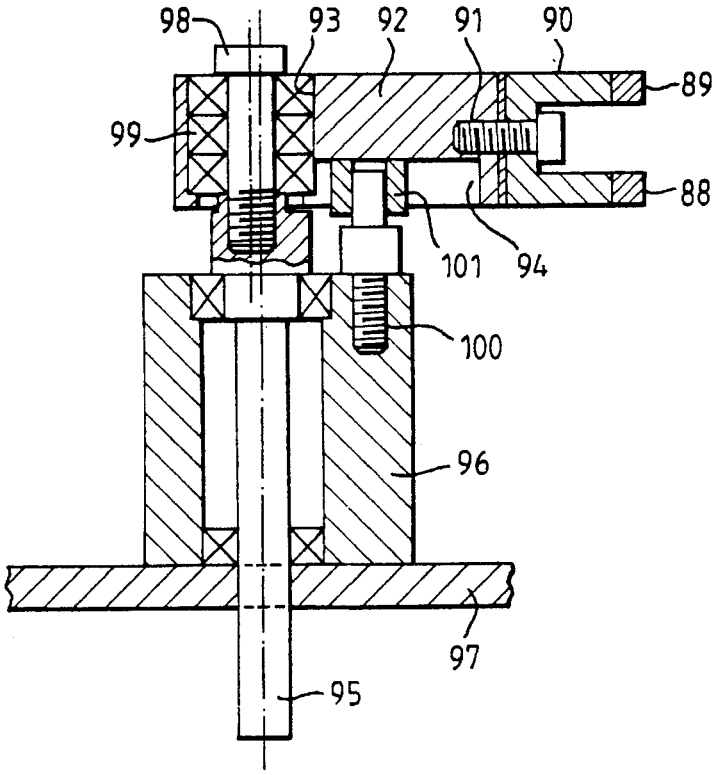
FIG. 13 is a cross-sectional view through the nudging assembly.

As can be seen in FIGS. 12 and 13, the nudging assembly 15 comprises a nudger block 90 having a U shape so as to define the arms 88, 89. The block 90 is secured by a bolt 91 to a support block 92 having a bore 93 and an elongate slot 94 on its under surface. The support block 92 is mounted on a shaft 95 rotatably supported in a bearing block 96 on a base plate 97, the upper end of the shaft 95 having screwed into it an eccentrically positioned bolt 98. The bolt 98 extends through bearings 99 in the bore 93. Movement of the support block 92 in response to rotation of the shaft 95 is constrained to be along an elliptical path by means of a pivot pin 100 mounted in the bearing block 96 and supporting a yoke 101. Thus, on rotation of the shaft 95, the arms 88, 89 regularly protrude through the slots 87, move towards the sheet exit 7, and then retract. The movement, which is indicated by an arrow 102 in FIG. 12, nudges the leading note in a stack towards the exit opening 7. The timing of the nudging movement is shown in FIG. 2*c*, where it can be seen that during most of the period 60, the nudging block 90 is retracted behind the face plate 3 so that the leading sheet is sucked onto the face plate. Just prior to the commencement of the period 62, the arms 88, 89 start to extend through the slots 87, pushing the leading note away from the face plate 3 and breaking the effect of the auxiliary vacuum. This protruding situation continues until after the end of periods 62 and 64 while the note continues to be drawn out by the peeler wheel 8 until mid-way through the period 61 when the arms 88, 89 withdraw behind the face plate 3.

The sheet holding device 18 comprises a manifold 120 having a pair of bores 121 through which respective pins 122 extend. The pins extend through the slots 192 in the face plate 3 and secure the manifold to the face plate. This is assisted by compression springs 123. The right-hand pin 122, as seen in FIG. 12, extends into a blind bore 124 in the side wall 5. Air or vacuum from the rotary control valve 26 is supplied to a bore 120A in the manifold 120 from which it passes through a conduit 120B to an outlet 120C at the face plate 3 for communication through some of apertures 190, 191 in the face plate. The manifold 120 can be moved along the face plate 3 simply by sliding it.

In the example shown, the manifold 120 is coupled with the side wall 5 so that movement of the side wall will also cause movement of the manifold. In FIG. 11, the side wall 5 is shown decoupled from the manifold 120.

As also can be seen in FIG. 12, the side wall 5 carries a resilient arm 130 which defines a rear extension of the side wall terminating in a stepped block 131. The arm 130 is vibrated by means of a cam 132 (see FIG. 16) mounted to rotate under the action of a motor 133, itself mounted to the side wall 5. The cam 132 acts on a cam follower block 134 mounted behind the block 131.

The block 131 has five steps 135 (see FIG. 12) extending progressively further towards the exit opening 7 and terminates in an angled section 136 extending at an obtuse angle to the face plate 3. As can be seen in FIG. 12, the angled end overlaps the thickness of the face plate 3.

FIG. 12 also illustrates how an end 4A of the guide wall 4 is angled towards the gap between the peeler wheel 8 and the contra-roller 9. The section 4A is substantially parallel with the arm 130.

In use, the motor 133 is rotated causing the arm 130 to vibrate, and this causes the first five or six notes in the stack on the tray 1 to be shingled with the leading note being pushed furthest towards the exit opening 7 as permitted by the angled section 4A.

Figure 14:
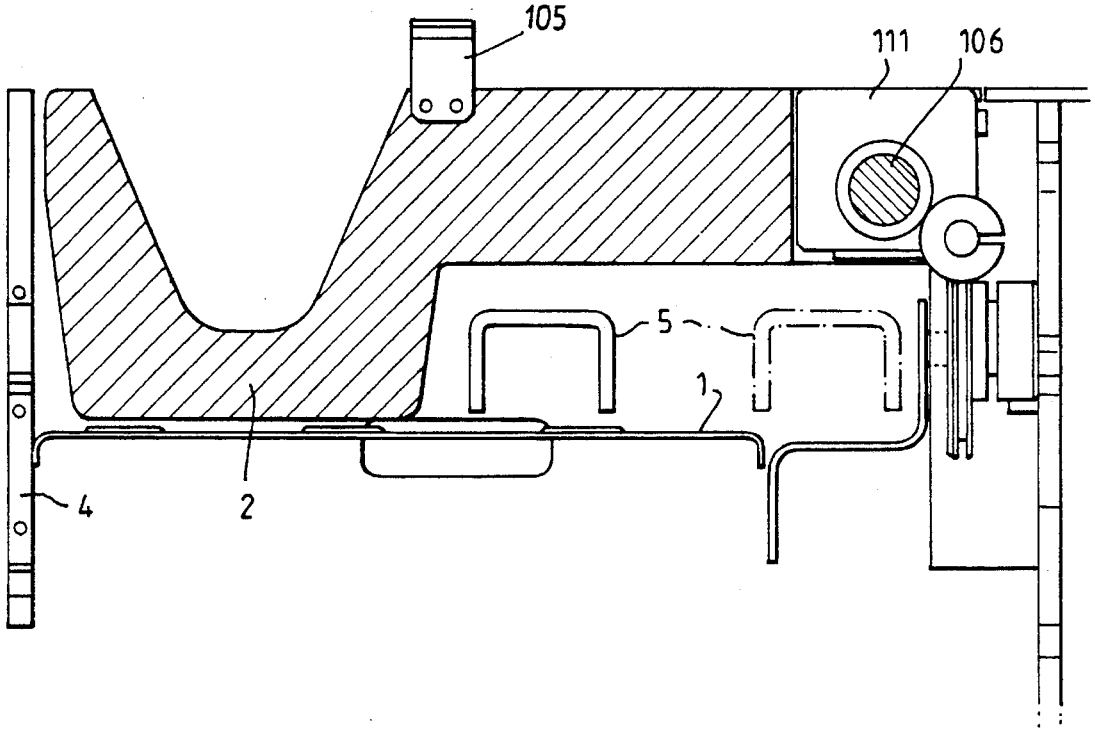
FIG. 14 is a partial bottom plan view illustrating the note tray paddle.

FIG. 14 shows a view of the paddle 2. A lifting handle 105 allows the operator to raise the paddle which is able to pivot about its support shaft 106. Bearings in a paddle block 111 allow the paddle to slide smoothly and with minimum friction along the support shaft 106. A spring 107 urges the paddle against the note stack 109 in the direction of the face plate 3.

Figure 15:
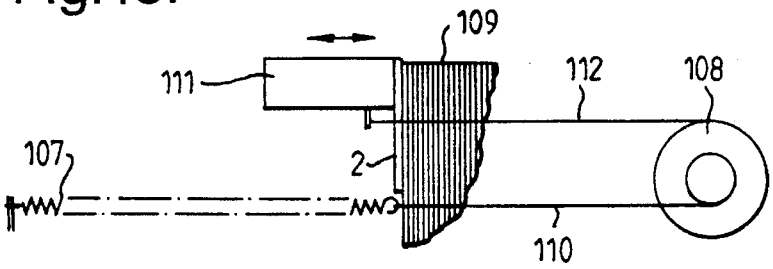
FIG. 15 is a diagrammatic view illustrating the biasing system for the paddle.

FIG. 15 shows the spring 107 and a pulley 108 which cause a magnification of movement from the spring to the paddle. In the arrangement shown in FIG. 15, the spring 107 is connected to the pulley 108 by a spring cord 110 while the pulley 108 is connected to a paddle block 111, slidably mounted about the shaft 106 and supporting the paddle 2, by a cord 112.

Figure 18A:
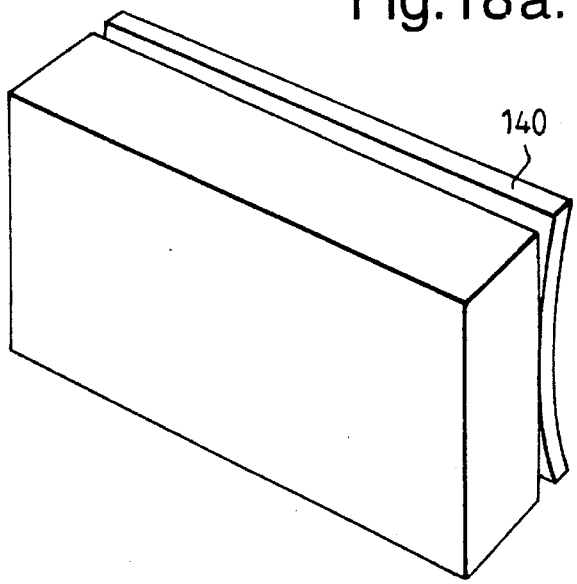
FIGS. 18*a*–18*c* are views to illustrate the handling of curved notes.
Figure 18B:
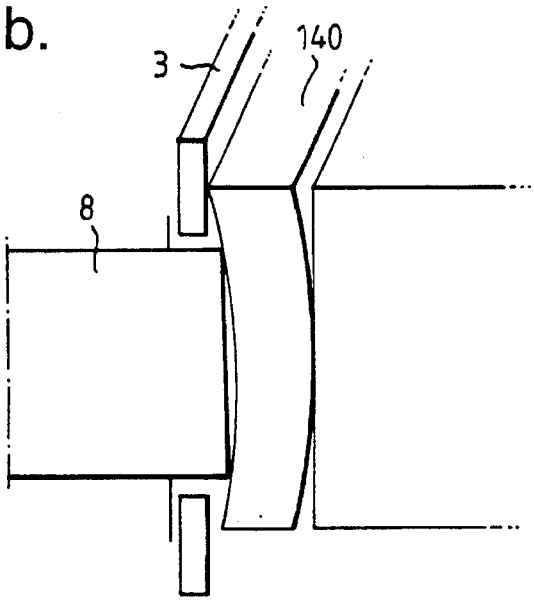

Some notes 140 may be curved about their long axis such that they do not rest against the peeler wheel 8. This may prevent the vacuum from pulling the notes onto the peeler wheel and, hence, into the machine (see FIGS. 18*a* and 18*b*).

Figure 18C:
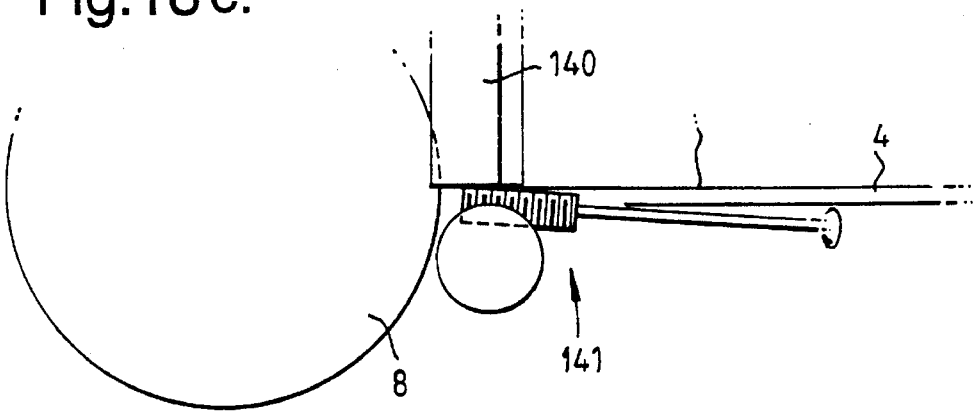

In an optional arrangement, when this occurs, the leading edge of the notes can be pushed against the peeler wheel 8 using a screw threaded note edge displacer 141 mounted on the wall 4 (see FIG. 18*c*). As the displacer 141 is rotated, the note edges are urged towards the peeler wheel 8.

As the notes are urged forward towards the wall 4, the displacer 141, the threads of which would extend slightly beyond the wall 4, would engage the notes' leading edge and cause the notes to compress against the peeler wheel 8. This would then allow the vacuum to act on the leading note and cause it to feed. It must be noted that the vacuum is present for a very small time only and cannot be effective if the note is not in close proximity to the peeler wheel surface.

Figure 19:
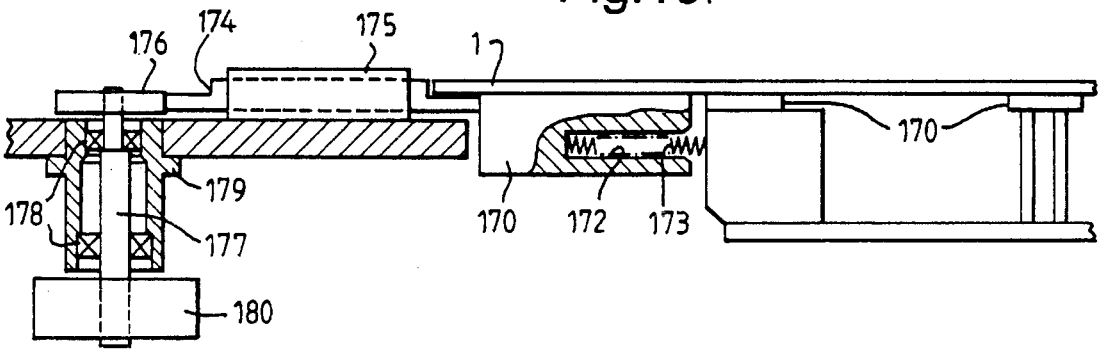
FIG. 19 is a partial cross-sectional view illustrating the mechanism for oscillating the note tray.
Figure 20:
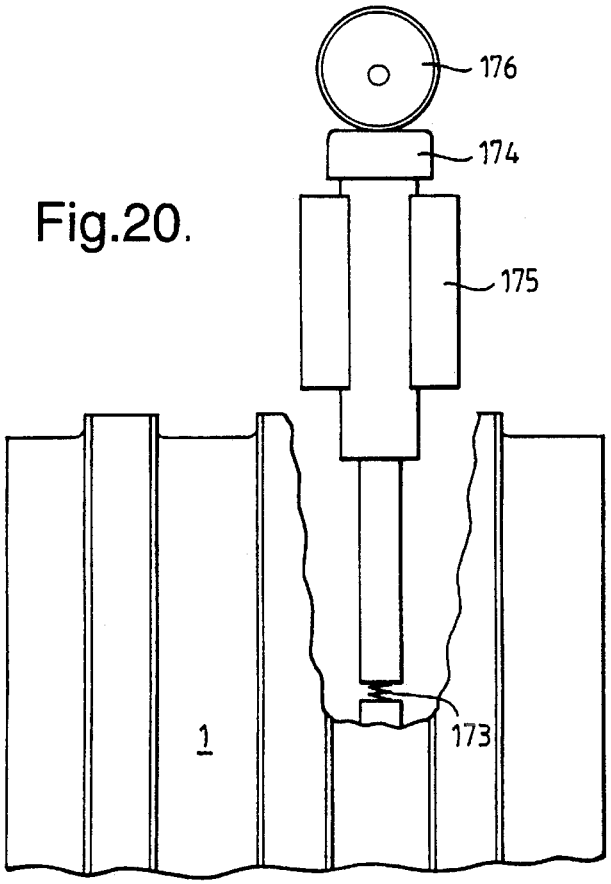
FIG. 20 is a partial side view with portions cut-away of the note tray showing the oscillating mechanism.

FIGS. 19 and 20 illustrate how the note tray 1 can be vibrated towards and away from the face plate 3. The note tray 1 is slidably supported on supports 170 and carries on its underside a block 171 having a cavity 172 in which is received a compression spring 173. The compression spring 173 acts against the block 171 and one of the supports 170 to urge the note tray 1 in a direction to the left, as seen in FIG. 19. The note tray 1 engages a push rod 174 engaging an eccentric 176. The eccentric 176 is mounted on a drive shaft 177 rotatably supported by bearing 178 in a housing 179. The drive shaft 177 is rotated via a pulley 180 by the transport mechanism 13, the connection to which is not shown. As can be seen, upon rotation of the drive shaft 177, the eccentric 176 will rotate causing the push rod 174 initially to move to the right, as seen in FIG. 19. This will move the note tray 1 to the right against the force of the compression spring 173. As the eccentric 176 continues to rotate, the spring 173 urges the tray and the push rod 174 back in a left-ward direction, thus vibrating the tray.

Thus, in operation, notes are fed by the peeler wheel 8 as described above, but in order to present the notes in an optimum manner for feeding, the note tray 1 is oscillated to and fro and at the same time, the arm 130 is vibrated to shingle the notes, the nudger assisting in feeding the notes to the peeler wheel 8.

It should be understood that the vibrating arm and/or vibrating tray could be used with other feed systems.

It is often important to provide a flow of air at the leading end of the stack of notes adjacent the note exit 7 to riffle the notes.

In one particular example, the operational parameters of the components are as follows:

| Component | Parameter |
|---|---|
| Peeler wheel diameter | 76.4 mm |
| Peeler wheel speed | 2000 rpm (linear speed 8 m/s |
| Rotary valve/rotary assembly speed | 1800 rpm (equivalent to 30 notes/second) |
| Nudger travel in note direction | 8 mm |
| Nudger travel perpendicular to note direction | 4 mm |
| Maximum nudger protrusion from base plate 3 | 2 mm |
| Vacuum level supplied to peeler wheel | −600 mbg |
| Vacuum level supplied to sheet holding device | −600 mbg |
| Pressure level supplied to peeler wheel | 50 mb |
| Pressure level supplied to vacuum pad | 680 mb |
| Vacuum level supplied to apertures | −200 mb |
| Note tray vibration frequency | 11 Hz |
| Vibrating arm frequency | 50 Hz |

I claim:

1. A sheet feed assembly for feeding sheets from a stack, the assembly comprising a vacuum feed device which is movable with a cyclic movement to feed a sheet from the stack in a feed direction while the sheet is held on said feed device under vacuum; a sheet holding device spaced from said vacuum feed device and positioned adjacent the stack for selectively preventing sheets from being fed from the stack; a vacuum source; and a control device coupled to said vacuum source, to said vacuum feed device and to said sheet holding device to selectively supply a vacuum from the vacuum source to said vacuum feed device to cause said device to feed a sheet and at substantially the same time to deactivate said sheet holding device so as to allow a single sheet to be fed by said vacuum feed device, whereby said control device controls the supply of vacuum to said feed device asynchronously with respect to said cyclic movement of said feed device.

2. An assembly according to claim 1, wherein, when activated, said sheet holding device applies a vacuum to the leading sheet in the stack, the assembly further comprising a source of air under pressure, connected to said control device said control device supplying air under pressure from said source to said sheet holding device when said sheet holding device is deactivated.

3. An assembly according to claim 2, wherein said control device supplies air under pressure to said sheet holding device for only part of the time during which a vacuum is supplied to said vacuum feed device.

4. An assembly according to claim 1, further comprising a source of air under pressure connected to the control device, said control device being adapted to supply air under pressure from said source to said vacuum feed device when vacuum is not supplied to said vacuum feed device.

5. An assembly according to claim 4, wherein said control device supplies air under pressure to said sheet holding device for only part of the time during which a vacuum is supplied to said vacuum feed device.

6. An assembly according to claim 4, wherein said control device supplies vacuum to said sheet holding device after vacuum ceases to be supplied to said vacuum feed device.

7. An assembly according to claim 4, further comprising a nudging device positioned between said vacuum feed device and said sheet holding device; and means for causing said nudging device periodically to move into engagement with a leading sheet in the stack, to nudge the sheet in the feed direction, and then to retract away from the sheet.

8. An assembly according to claim 7, wherein said means causes said nudging device to nudge the leading sheet when the sheet is being fed by said vacuum feed device.

9. An assembly according to claim 4, further comprising a support member against which the stack is urged, said support member having a depressed section adjacent said vacuum feed device; and an auxiliary suction device for communicating an auxiliary vacuum through said depressed section of said support plate.

10. An assembly according to claim 9, wherein said auxiliary vacuum is less than the vacuum applied by said vacuum feed device.

11. An assembly according to claim 9, further comprising a nudging device positioned between said vacuum feed device and said sheet holding device; and means for causing said nudging device periodically to move into engagement with a leading sheet in the stack, to nudge the sheet in the feed direction, and then to retract away from the sheet, wherein said nudging device engages with the leading sheet through an aperture in said depressed section of said support member.

12. An assembly according to claim 11, wherein the aperture is adjacent the position at which the auxiliary vacuum is communicated through the support member.

13. A sheet feed assembly according to claim 4, wherein said vacuum feed device includes a rotatable member having a plurality of holes or grooves around its circumference, and an internal porting member about which said rotatable member rotates, and having an outlet which communicates with one or a number of the plurality of holes or grooves of said rotatable member.

14. An assembly according to claim 13, wherein said control device comprises a pair of valves with one valve of the pair being connected to said vacuum feed device and another valve of the pair being connected to said sheet holding device and each valve having two input ports coupled in use to sources of vacuum and pressure, respectively, and an output port which is selectively connectable to either one of said input ports.

15. An assembly according to claim 14, further comprising a fluid control valve which causes pressure to be continuously supplied to the two inlet ports of the one valve connected to said vacuum feed device when it is desired not to feed a sheet.

16. An assembly according to claim 14, wherein said one valve connected to said vacuum feed device is mounted concentrically with said rotatable member.

17. An assembly according to claim 1, wherein said control device supplies vacuum from the vacuum source to said sheet holding device after vacuum ceases to be supplied to said vacuum feed device.

18. An assembly according to claim 1, further comprising a nudging device positioned between said vacuum feed device and said sheet holding device; and means for causing said nudging device periodically to move into engagement with a leading sheet in the stack, to nudge the sheet in the feed direction, and then to retract away from the sheet.

19. An assembly according to claim 18, wherein said means causes said nudging device to nudge the leading sheet when the sheet is being fed by said vacuum feed device.

20. An assembly according to claim 1, further comprising a support member against which the stack is urged, said support member having a depressed section adjacent said vacuum feed device; and an auxiliary suction device for communicating an auxiliary vacuum through said depressed section of said support plate.

21. An assembly according to claim 20, wherein said auxiliary vacuum is less than the vacuum applied by said vacuum feed device.

22. An assembly according to claim 20, further comprising a nudging device positioned between said vacuum feed device and said sheet holding device; and means for causing said nudging device periodically to move into engagement with a leading sheet in the stack, to nudge the sheet in the feed direction, and then to retract away from the sheet, wherein said nudging device engages with the leading sheet through an aperture in said depressed section of said support member.

23. An assembly according to claim 22, wherein the aperture is adjacent the position at which the auxiliary vacuum is communicated through the support member.

24. A sheet feed assembly according to claim 1, wherein said vacuum feed device includes a rotatable member having a plurality of holes or grooves around its circumference, and an internal porting member about which said rotatable member rotates, said internal parting member having an outlet which communicates with one or a number of the plurality of holes or grooves of said rotatable member.

25. An assembly according to claim 24, wherein said control device comprises a pair of valves with one valve of the pair connected to said vacuum feed device and another valve of the pair connected to said sheet holding device and each valve having two input ports coupled in use to sources of vacuum and pressure, respectively, and an outer port which is selectively connectable to either one of said input ports.

26. An assembly according to claim 25, wherein said valves are rotary valves, the rotational frequency of the valves being different from the rotational frequency of the rotatable member.

27. An assembly according to claim 26, wherein the ratio of said two frequencies is a non-integral value.

28. An assembly according to claim 25, further comprising a fluid control valve which causes pressure to be continuously supplied to the two said inlet ports of the one valve connected to said vacuum feed device when it is desired not to feed a sheet.

29. An assembly according to claim 25, wherein said one valve connected to said vacuum feed device is mounted concentrically with said rotatable member.

30. A sheet handling system including a sheet feed assembly for feeding sheets from a stack, the assembly comprising a vacuum feed device which is movable with a cyclic movement to feed a sheet from the stack in a feed direction while the sheet is held on said feed device under vacuum; a sheet holding device spaced from said vacuum feed device and positioned adjacent the stack for selectively preventing sheets from being fed from the stack; a vacuum source: and a control device coupled to the vacuum source, to said vacuum feed device and to said sheet holding device to selectively supply a vacuum from said vacuum source to said vacuum feed device to cause said device to feed a sheet and at substantially the same time, to deactivate said sheet holding device so as to allow a single sheet to be fed by said vacuum feed device, whereby said control device controls the supply of vacuum to said feed device asynchronously with respect to said cyclic movement of said feed device; and a sheet transporting system for transporting sheets fed to it by said sheet feed assembly.

31. A sheet feed assembly for feeding sheets from a stack, the assembly comprising a vacuum feed device which is movable to feed a sheet from the stack in a feed direction while the sheet is held on said feed device under vacuum; a sheet holding device spaced from said vacuum feed device and positioned adjacent the stack for selectively preventing sheets from being fed from the stack; a source of air under pressure; a vacuum source; and a control device coupled to said vacuum source, said vacuum feed device, said source of air under pressure and to said sheet holding device to selectively supply a vacuum from the vacuum source to said vacuum feed device to cause said device to feed a sheet and, at substantially the same time, to deactivate said sheet holding device by supplying air under pressure from said source of air to said sheet holding device so as to allow a single sheet to be fed by said vacuum feed device.

32. A sheet handling system including a sheet feed assembly comprising a vacuum feed device which is movable to feed a sheet from the stack in a feed direction while the sheet is held on said feed device under vacuum; a sheet holding device spaced from said vacuum feed device and positioned adjacent the stack for selectively preventing sheets from being fed from the stack; a vacuum source; a source of air under pressure; and a control device coupled to said vacuum source, said vacuum feed device, said source of air under pressure and to said sheet holding device to selectively supply a vacuum from said vacuum source to said vacuum feed device to cause said device to feed a sheet and, at substantially the same time, to deactivate said sheet holding device by supplying air under pressure from said source of air to said sheet holding device so as to allow a single sheet to be fed by said vacuum feed device; and a sheet transporting system for transporting sheets fed to it by said sheet feed assembly.

33. A sheet presenting assembly for presenting a stack of sheets to a sheet feed device which withdraws sheets from the stack through a sheet exit, the assembly comprising a support member towards which the faces of sheets in a stack are urged, the sheet exit being positioned at one end of said support member; a biasing member for urging the sheet stack towards said support member; a first sheet guide wall extending in the urging direction alongside the sheet stack towards said support member and terminating at a position spaced from said support member to define said sheet exit; a second guide wall laterally spaced from said first guide wall and extending towards said support member whereby a stack of sheets is positioned between said first and second guide walls, at least one of said first and second guide walls having a shaped part adjacent said support plate to extend in said sheet exit direction; and means for vibrating at least sheets near said support member in such a way that they are urged to take up an overlapping arrangement in said sheet exit direction by said shaped part.

34. An assembly according to claim 33, wherein said second guide wall includes a wall section adjacent said support member, said wall section presenting at least two steps facing generally towards said sheet exit which engage trailing ends of sheets whereby as sheets approach said support plate under said biasing action, their trailing edges engage said wall section of said second guide wall so that said sheets are urged successively nearer said sheet exit.

35. An assembly according to claim 34, wherein said wall section extends generally linearly towards said sheet exit as it approaches said support member.

36. An assembly according to claim 34, wherein the steps are provided only in a region of said wall section near said support member.

37. An assembly according to claim 34, wherein said wall section overlaps said support member so that no sheets can move laterally away from said sheet exit.

38. An assembly according to claim 37, wherein the surface of the part of the wall section overlapping said support member and facing said sheet exit is at an obtuse angle to said support plate.

39. An assembly according to claim 34, wherein said wall section comprises a resilient arm, and wherein said vibrating means comprises a motor and an eccentric cam rotated by the motor to cause said resilient arm to vibrate.

40. An assembly according to claim 33, wherein said support member is an upright plate.

41. An assembly according to claim 33, further comprising a nudging device and means for causing the nudging device periodically to extend through said support plate between the sheet exit and the sheet guide wall to engage with a leading sheet in the stack, to nudge the sheet towards the sheet exit, and then to retract.

42. An assembly according to claim 41, wherein said support member has a depressed section adjacent the sheet exit, the assembly further comprising a suction device for communicating vacuum through said depressed section, and wherein said nudging device engages with the leading sheet through an aperture in said depressed section of said support member.

43. An assembly according to claim 42, wherein said aperture is adjacent the position at which the vacuum is supplied through said depressed section.

44. An assembly according to claim 33, wherein said support member has a depressed section adjacent the sheet exit, the assembly further comprising a suction device for communicating vacuum through said depressed section.

45. An assembly according to claim 33, wherein said second sheet guide wall is mounted to be laterally movable towards and away from said sheet exit to accommodate different sheet sizes.

46. An assembly according to claim 33, in combination with a sheet feed assembly for feeding sheets from a stack, the assembly comprising a vacuum feed device which is movable with a cyclic movement to feed a sheet from the stack in a feed direction while the sheet is held on said feed device under vacuum; a sheet holding device spaced from said vacuum feed device and positioned adjacent the stack for selectively preventing sheets from being fed from the stack; a vacuum source and a control device coupled to said vacuum source, to said vacuum feed device and to said sheet holding device to selectively supply a vacuum from said vacuum source to said vacuum feed device to cause said device to feed a sheet and, at substantially the same time, to deactivate said sheet holding device so as to allow a single sheet to be fed by said vacuum feed device, whereby said control device controls the supply of vacuum to said feed device asynchronously with respect to said cyclic movement of said feed device, the vacuum feed device of said sheet feed assembly being positioned adjacent said exit of said sheet presenting assembly.

47. A combination according to claim 46, wherein said sheet holding device is connected to said second sheet guide wall for movement therewith.

48. A combination according to claim 46, wherein the means for vibrating has a vibration frequency greater than a sheet feed frequency of the cyclic movement of the vacuum feed device.

49. An assembly according to claim 33, in combination with a sheet feed assembly comprising a vacuum feed device which is movable to feed a sheet from the stack in a feed direction while the sheet is held on said feed device under vacuum; a sheet holding device spaced from said vacuum feed device and positioned adjacent the stack for selectively preventing sheets from being fed from the stack; a source of air under pressure; and a control device coupled to said vacuum feed device, said source of air under pressure and to said sheet holding device to selectively supply a vacuum to said vacuum feed device to cause said device to feed a sheet and, at substantially the same time, to deactivate said sheet holding device by supplying air under pressure from said source to said sheet holding device so as to allow a single sheet to be fed by said vacuum feed device, the vacuum feed device of the said sheet feed assembly being positioned adjacent said exit of said sheet presenting assembly.

50. A combination according to claim 49, wherein said sheet holding device is connected to said second sheet guide wall for movement therewith.

51. A combination according to claim 49, wherein the means for vibrating has a vibration frequency greater than a sheet feed frequency of the vacuum feed device.

52. A sheet handling system comprising a sheet presenting assembly according to claim 33; a sheet feed device to which sheets are presented by the sheet presenting assembly; and a sheet transport system for transporting sheets fed to it by the sheet feed assembly.

53. A system according to claim 52, wherein the speed at which sheets are transported by the sheet transport system is substantially the same as the speed at which sheets are fed by the sheet feed device.

54. A sheet presenting assembly according to claim 33, further comprising a base on which edges of sheets are stacked and an oscillating device for oscillating said base in a plane of the base relative to said support member.

55. A sheet presenting assembly for holding a stack of sheets and for use with a sheet feed device for withdrawing sheets from the stack through a sheet exit, the sheet presenting assembly comprising a planar base with a planar surface on which edges of sheets are stacked; a support member at one end of said base towards which the faces of the sheets are urged by biasing means; an oscillating device for oscillating said base in an oscillation direction in a plane of the base toward and away from said support member: and wherein said sheet exit is positioned so that sheets, are withdrawn from the stack in a lateral direction relative to the plane of the base and transverse to the oscillation direction.

56. An assembly according to claim 55, wherein the oscillation frequency is in the range of 3–15Hz.

57. A sheet handling system comprising a sheet presenting assembly according to claim 55; a sheet feed device to which sheets are presented by the sheet presenting assembly; and a sheet transport system for transporting sheets fed to it by the sheet feed assembly.

58. A system according to claim 57, wherein the speed at which sheets are transported by the sheet transport system is substantially the same as the speed at which sheets are fed by the sheet feed device.

59. A method of feeding sheets from a stack using a sheet feed assembly comprising a vacuum feed device which is movable with a cyclic movement to feed a sheet from the stack in a feed direction while the sheet is held on the feed device under vacuum, and a sheet holding device spaced from the vacuum feed device adjacent the stack in use for selectively preventing sheets being fed from the stack, the method comprising selectively supplying vacuum to said vacuum feed device to cause the device to feed a sheet and, at substantially the same time, deactivating the sheet holding device so as to allow a single sheet to be fed by the vacuum feed device, whereby vacuum is supplied to said feed device asynchronously with respect to the cyclic movement of said feed device.

60. A method according to claim 59, wherein said sheet holding device is activated by supplying vacuum thereto, the method further comprising supplying air under pressure to the sheet holding device when said sheet holding device is deactivated.

61. A method according to claim 60 wherein air is supplied for only part of the time during which vacuum is supplied to the vacuum feed device.

62. A method according to claim 59, wherein vacuum is supplied to said sheet holding device after vacuum ceases to be supplied to said vacuum feed device.

63. A method according to claim 59, wherein air under pressure is supplied to said vacuum feed device when vacuum is not supplied to said vacuum feed device.

64. A method of feeding sheets from a stack using a sheet feed assembly comprising a vacuum feed device which is movable to feed a sheet from the stack in a feed direction while the sheet is held on the feed device under vacuum, and a sheet holding device spaced from the vacuum feed device adjacent the stack in use for selectively preventing sheets being fed from the stack, the method comprising selectively supplying vacuum to said vacuum feed device to cause the device to feed a sheet and, at substantially the same time, deactivating said sheet holding device so as to allow a single sheet to be fed by said vacuum feed device by supplying air under pressure so as to allow a single sheet to be fed by said vacuum feed device.

65. A method according to claim 64, wherein air is supplied for only part of the time during which vacuum is supplied to the vacuum feed device.

66. A method according to claim 64, wherein vacuum is supplied to said sheet holding device after vacuum ceases to be supplied to said vacuum feed device.

67. A method according to claims 64, wherein air under pressure is supplied to said vacuum feed device when vacuum is not supplied to said vacuum feed device.

* * * * *